United States Patent [19]

Preszler et al.

[11] Patent Number: 5,053,820

[45] Date of Patent: Oct. 1, 1991

[54] DEVELOPING MODULE DRIVE SYSTEM FOR AN ELECTROGRAPHIC PRINTER

[75] Inventors: Duane A. Preszler, River Falls; Gregory L. Zwadlo, Ellsworth, both of Wis.

[73] Assignee: Minnesota Mining & Manufacturing Company, St. Paul, Minn.

[21] Appl. No.: 491,499

[22] Filed: Mar. 12, 1990

[51] Int. Cl.[5] ..... G03G 15/06

[52] U.S. Cl. ..... 355/245; 355/326

[58] Field of Search ..... 355/326, 327, 328, 245, 355/256, 260

[56] References Cited

U.S. PATENT DOCUMENTS

| | | | |
|---|---|---|---|
| 4,146,324 | 3/1979 | Komori et al. | 355/256 |
| 4,640,605 | 2/1987 | Ariyama et al. | 355/327 |
| 4,728,983 | 3/1988 | Zwadlo et al. | 355/160 |
| 4,728,987 | 3/1988 | Diola et al. | 355/245 |
| 4,754,302 | 6/1988 | Komatsubara et al. | 355/298 |
| 4,796,051 | 1/1989 | Monkelbaan et al. | 355/307 |
| 4,797,703 | 1/1989 | Guslits | 355/212 |
| 4,800,839 | 1/1989 | Ariyama et al. | 118/691 |
| 4,841,329 | 6/1989 | Kasamura et al. | 355/326 X |
| 4,841,336 | 6/1989 | Kusumoto et al. | 355/326 X |
| 4,891,672 | 1/1990 | Takagi | 355/326 X |
| 4,894,684 | 1/1990 | Nakajima et al. | 355/326 X |
| 4,937,624 | 6/1990 | Kotani et al. | 355/326 X |
| 4,937,626 | 6/1990 | Kotani et al. | 355/326 X |

FOREIGN PATENT DOCUMENTS

| | | | |
|---|---|---|---|
| 0121875 | 5/1988 | Japan | 355/326 |
| 0121877 | 5/1988 | Japan | 355/326 |

OTHER PUBLICATIONS

Efrem Lieber, "Making Sense Out of All Those Proofing Devices", *Printing Impressions*, 9/1988, pp. 33–34.

Jody M. Kenyon, "A Proof In Time", *American Printer*, 9/1988, pp. 31–34.

Jack Powers, "Desktop Color Separation:", *Computer Pictures*, Jul.-Sep./1988, pp. 27–28, 30–31.

*Printing Impressions*, "Here They Are: The 30 Largest Color Separators", 9/1988, pp. 22–25.

Minnesota Mining and Manufacturing Corporation, "Press Release-3 M Direct Digital Color Proofing Systems (DDCP) Described at IPEX", 7/1988, pp. 1–7.

*Primary Examiner*—R. L. Moses

*Assistant Examiner*—Sandra L. Hoffman

*Attorney, Agent, or Firm*—Kinney & Lange

[57] ABSTRACT

A drive system for positioning any one of a plurality of toner developing modules relative to a photoconductor drum of an electrographic printer includes an indexing assembly having a chain drive mechanism. The chain drive mechanism includes a motor driven tow bar that is configured to releasably engage a tow hook mounted to a movable toner cart. The toner cart includes a developer rack that supports the plurality of developing modules. The drive system further includes a lift assembly that is configured to engage any one of developing modules and move it away from the rack to a developing position adjacent the photoconductor drum and back to the developer rack. The lift assembly includes a pair of lift arms, each of which is defined by a four bar linkage. The lift arms include hook assemblies that are configured to engage lift pins mounted on opposite ends of the developing modules. Each hook assembly includes a first centering member that supports a movable spring biased second centering member. The opposite ends of the modules are configured to engage first gaping surfaces of a pair of gaping cams mounted adjacent to the photoconductor drum. This engagement establishes the vertical gap clearance needed between the drum and module for the developing process. The opposite ends of the modules are further configured to engage second gaping surfaces of the gaping cams to define the developing position of the developing modules.

47 Claims, 7 Drawing Sheets

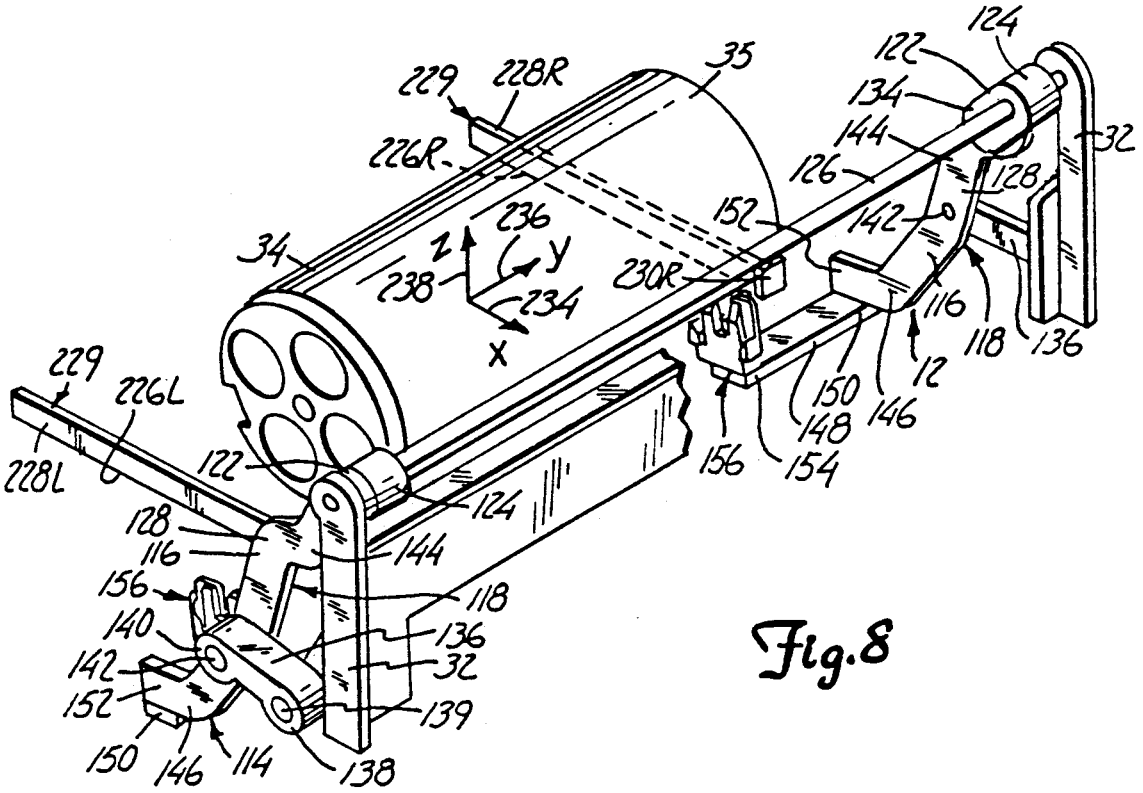
Fig. 8
Fig. 3
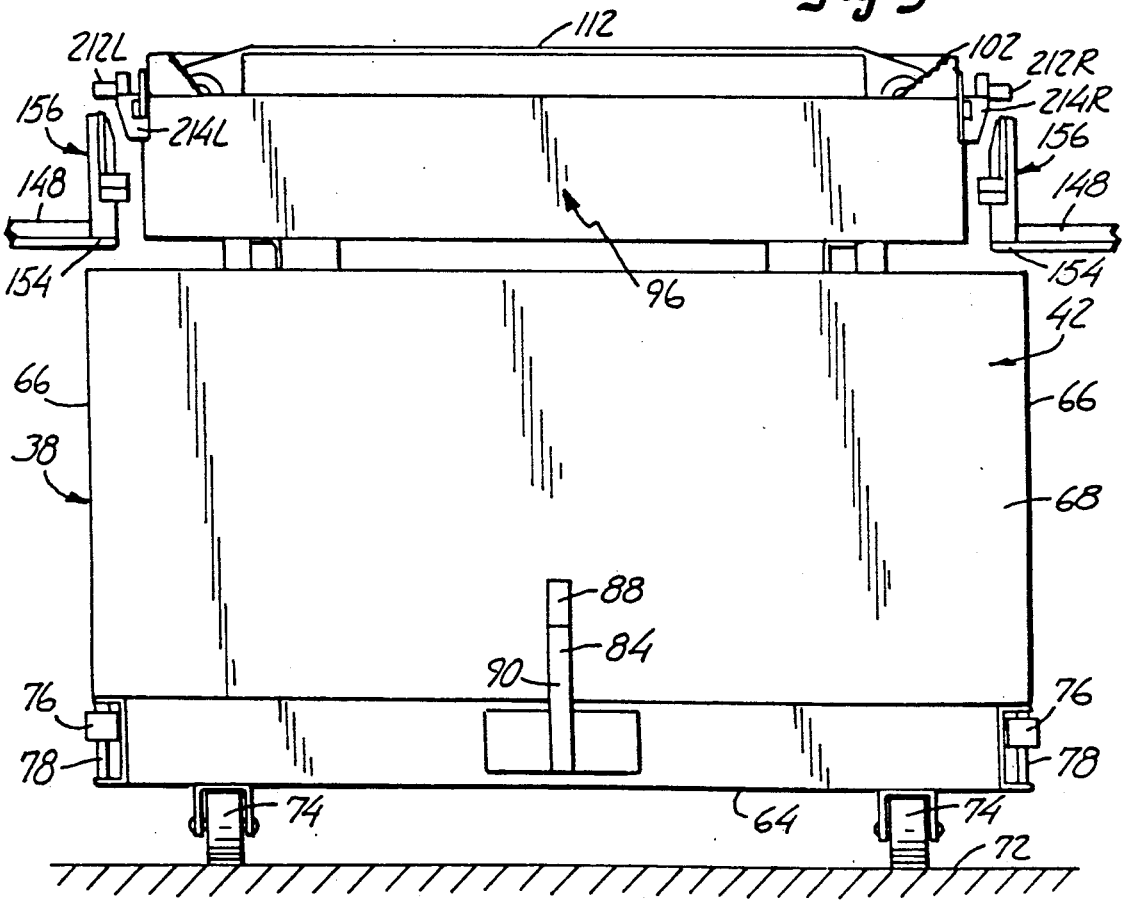

DEVELOPING MODULE DRIVE SYSTEM FOR AN ELECTROGRAPHIC PRINTER

BACKGROUND OF THE INVENTION

This invention pertains generally to multicolor electrographic printing devices. In particular, the present invention is a drive system for positioning any one of a plurality of liquid toner developing modules relative to a photoconductor of an electrographic printer.

Typically, to produce a multicolor print a photoconductive member of the electrographic printer is first charged to a uniform potential to sensitize its imaging surface. The charged surface of the photoconductive member is exposed to an image of an original document that is to be reproduced as a multicolor print. This procedure allows the photoconductive member to record an electrostatic latent image corresponding to the informational areas contained within the image of the original document.

To form a multicolor print, successive images of the original document are optically filtered through different colored filters and recorded on the photoconductive member. These latent images are then developed with different colored toner fluids supplied from corresponding developing modules. The color of the toner fluid in the particular developing module corresponds to the subtractive primary of the color of the optical filter. Electrographic printing is normally done with yellow, cyan and magenta toner fluids. Usually the electrographic printer also includes a developing module having black toner fluid since it is required in virtually all commercial color printing applications.

The different colored developed images are transferred from the photoconductive member to a print medium in superimposed registration with one another. A half tone screen is used to expose the latent images to create multisized dots that produce the varying color tones needed to duplicate the original document. Heat is usually applied to permanently fuse the image to the print medium to form a completed multicolor print.

One such electrographic printer is disclosed in the Komatsubara et al. U.S. Pat. No. 4,754,302. This multicolor electrographic printer includes a rotatable photoconductor drum. The drum is configured to hold a sheet of photosensitive material on its peripheral surface. The developing apparatus includes a plurality of color developing devices. Each developing device holds a different color of toner fluid, such as yellow, magenta and cyan. The developing devices are mounted on a carriage which is movable linearly within the electrographic printer on a pair of guide rails.

A driving mechanism including a drive motor and a chain is used to move the carriage to position any one of the developing devices beneath the photoconductor drum as required. Each color developing device includes a case body used to contain a supply of color toner fluid. A feed pump within the case body delivers toner fluid to a developing head that forms an electrode plate. A lifting mechanism which includes a push-up motor, a push-up crank mechanism and a pair of push-up rods is used to lift the entire developing device, including the case body and developing head, into a developing position adjacent the photoconductor drum.

The developing head includes a pair of spaced rollers that contact the photoconductor drum in the developing position and act to space the developing head from the photoconductor drum a needed clearance amount.

The gap formed between the developing head and the photoconductor drum is filled with toner fluid during the developing process. A spring between the developing head and the case body acts to bias the head into contact with the photoconductor drum. The lifting mechanism is used to lift any one of the plurality of developing devices into the developing position as required to form the multicolor print.

To remove excess toner fluid from the image carrying surface of the photoconductor drum a toner recovery blade is moved into contact with the drum and as the drum rotates, the blade removes the excess toner fluid from the imaging surface. The toner fluid flows down the toner recovery blade and returns to the case body where the toner fluid supply is stored. An air knife is also used to facilitate removal of the excess fluid from the imaging surface of the photoconductor drum.

To insure a high quality multicolor print, the positioning of the developing modules relative to the photoconductive member during the developing process must be held to stringent tolerances. Therefore, the gap clearance between the developing module and photoconductive member must be precisely maintained. As mentioned above, the electrographic printer of Komatsubara et al. U.S. Pat. No. 4,754,302 uses rollers, mounted on the developing head, that contact the photoconductor drum to maintain this gap clearance. Frequently, these rollers become coated with toner fluid and the precise positioning needed to produce a high quality multicolor print is lost. To regain the proper gap clearance the rollers must be cleaned, which translates into machine down time. In addition, to produce a sharp multicolor print each developing module must be properly aligned with the photoconductive member. The electrographic printer of Komatsubara et al. relies on the accuracy of the driving and lifting mechanisms themselves to achieve the proper alignment of the developing device relative to the photoconductor drum. Thus, the accuracy of the driving mechanism and the lifting mechanism must be monitored and routinely adjusted to insure alignment.

There is a continuing need for improved drive systems for positioning a liquid toner developing module relative to a photoconductor. Specifically, there is a need for a drive system that allows precise positioning of the developing module relative to the photoconductor in vertical and horizontal axes without contacting the photoconductor itself, and thereby lessening any chance of distorting the image produced by the developing process. Moreover, there is a need for a drive system that compensates for inaccuracies in the drive system components which may cause misalignment of the developing module relative to the photoconductor during the developing process. The drive system should include mechanisms which provide latitude for positioning drive system components relative to one another while maintaining the precise gap clearance required between the developing module and the photoconductor itself.

SUMMARY OF THE INVENTION

The present invention is a drive system for use in an electrographic printer for positioning a liquid toner developing module relative to a photoconductor mounted to a frame of the printer. The drive system includes a developer rack for supporting the liquid toner developing module. A lift assembly is movably mounted to the printer frame above the developing module. A motor moves the lift assembly relative to the frame so as to releasably engage the developing module and move it from a stored position, wherein the developing module is supported on the developer rack to a developing position adjacent the photoconductor to effectuate a developing process.

The developer rack is configured to support a plurality of the developing modules, and the lift assembly is designed to engage any one of the modules and move it between the stored and developing positions. The developer rack forms part of an indexing assembly that also includes a toner cart for supporting the developer rack. The toner cart is supported by casters and houses the components necessary to supply liquid toner to the developing modules. This arrangement allows the toner cart together with the modules to be moved away from the printer to permit the modules to be replenished with liquid toner and allow routine maintenance to be performed on the modules themselves.

The indexing assembly further includes a chain drive mechanism mounted to the printer frame that is configured to releasably engage the toner cart and position it relative to the lift assembly so that the lift assembly can engage one of the modules. The chain drive mechanism includes a tow bar driven by a stepper motor through a pair of continuous chains that is adapted to releasably engage a toner cart hook mounted to the toner cart. The toner cart includes a plurality of guide rollers that contact guide rails that center the cart within the printer frame as the chain drive mechanism moves the cart along the longitudinal extent of the printer.

The lift assembly includes a pair of spaced lift arms having hook assemblies that are configured to engage opposite ends of the developing module positioned beneath the lift assembly by the indexing assembly. The lift arms each include a four bar linkage defined by a drive link rotatably attached to the frame of the printer, a coupler link rotatably coupled to the drive link and a follower link rotatably coupled to the printer frame and the median of the coupler link. The hook assemblies are rigidly attached to spacer bars secured to the coupler links. A stepper motor drives the lift arms such that the hook assemblies engage the developing module from below and lift it off of the developer rack and away from the stored position.

The hook assemblies each include a first centering member attached directly to the spacer bar and a second centering member movably supported by the first centering member. The second centering member is slidably supported in a first channel formed in the first centering member. A leaf spring attached to the first centering member biases the second centering member in a first rearward direction relative to the first centering member. The first centering member further includes a second channel perpendicular to the first channel, and the second centering member includes an elongated channel that is in aligned registry with the second channel of the first centering member. A peg is movably supported in an opening formed at the junction of the first and second channels. A spring biases the peg upwardly and a groove formed in the peg is configured to freely receive the second centering member so as to allow the second centering member to move within the first channel. The second centering member further includes a pair of outwardly extending positioning ears having inclined guide surfaces.

Opposite ends of the developing modules include lift pins that are adapted to be engaged by the aligned second and elongated channels of the first and second centering members, respectively. Once engaged by the hook assemblies the lift pins are supported within the aligned second and elongated channels by the spring biased pegs. This arrangement provides a secure engagement while the module is moved between the stored and developing positions. Walls of the second and elongated channels include beveled guide surfaces that act to direct the lift pins to the middle of the second and elongated channels if the module is slightly misaligned with respect to the hook assemblies as the lift assembly lifts the developing module off of the developer rack. The first centering members further includes slanted guide surfaces that coact with ramped guide surfaces on the ends of the developing module to center the module between the lift arms if it is slightly misaligned relative to the hook assemblies as the lift assembly raises the module from the stored position. The inclined guide surfaces of the positioning ears of the second centering members are engageable with the ends of the developing module, and act to limit the rotation of the module about an axis formed by the lift pins once the module is lifted from the stored position.

The printer further includes a gaping cam mechanism defined by a pair of spaced gaping cams mounted to the frame adjacent to opposite ends of the photoconductor. The gaping cams each include a first gaping surface that defines a vertically gaped predeveloping position of the developing module, and establishes a needed clearance gap between the module and the photoconductor for the developing process. Each of the gaping cams further includes a second gaping surface, adjacent to the first gaping surface, that defines a horizontally gaped position of the module, and establishes the developing position of the developing module.

The ends of the modules include first support portions that include adjustable, vertical gaping pins. As the lift arms move the module away from the developer rack, the adjustable, vertical gaping pins eventually engage the first gaping surfaces of the gaping cams and thus accurately position the module with the needed vertical gap clearance in relation to the photoconductor. At this time the developing module is in the predeveloping position. Further movement of the lift arms sweeps the module along the first gaping surfaces of the gaping cams.

The ends of the developing modules further include second support portions that include adjustable, horizontal gaping pins. As the module is swept along the first gaping surfaces the adjustable, horizontal gaping pins eventually engage the second gaping surfaces of the gaping cams. When the horizontal gaping pins are engaged with the second gaping surfaces, the module is in the developing position adjacent the photoconductor. In the developing position, movement of the lift arms ceases and the developing process is effectuated (i.e., toner fluid supplied by the module is deposited on the latent image recorded on the photoconductor). The spring biased pegs and the spring biased second centering members act as overdrive mechanisms by allowing the lift arms to overdrive the pre-developing and developing positions when the lifted module is engaged with the first and second gaping surfaces. These overdrive mechanisms further compensate for the path of movement of the hook assemblies due to the four bar linkages of the lift arms.

After the developing process, the stepper motor of the lift arms is reversed to return the developing module back to the developing rack. During any movement of the lift arms, the indexing assembly operates in a synchronized manner with the stepper motor for the lift arms to prevent the module and hook assemblies from colliding with adjacent portions of the developer rack or other modules supported on the rack.

This drive system is relatively uncomplicated and the first and second gaping surfaces of the gaping cams allow precise positioning of the developing modules in both horizontal and vertical axes without the need for contacting the photoconductor itself. Since the developing modules do not contact the photoconductor, the likelihood that the image produced by the developing process will be distorted is significantly reduced. In addition, the overdrive mechanisms provided by the spring biased pegs and second centering members allow latitude in the positioning of the drive system components, while maintaining the precise gap clearance required between the developing module and the photoconductor for the developing process. Moreover, the positioning assemblies of this drive system compensate for inaccuracies in the drive system components which may cause pickup misalignment between the developing module and the hook assemblies. Specifically, the components are dimensioned so that the coaction between the slanted guide surfaces of the first centering member and the ramped guide surfaces of the module ends provides approximately ±3 mm of developing module pickup positioning latitude in the transverse direction (i.e., Y-axis) of the printer. The beveled guide surfaces of the second and elongated channels of the first and second centering members, respectively, provide approximately ±6 mm of developing module pickup positioning latitude in the longitudinal direction (i.e., X-axis) of the printer. In the vertical direction (i.e., Z-axis) motion of the lift arms due to the four bar linkages provides approximately ±12 mm of developing module pickup positioning latitude. Lastly, the inclined guide surfaces of the positioning ears limit the developing module to approximately ±15° of rotational freedom about the longitudinal axis of the developing module as defined by the lift pins.

BRIEF DESCRIPTION OF THE DRAWINGS

FIG. 3 is an end elevational view of the toner cart that forms part of the drive system.

FIG. 8 is a perspective view of the lift assembly shown in conjunction with the photoconductive drum assembly.

DETAILED DESCRIPTION OF THE PREFERRED EMBODIMENTS

Figure 1:
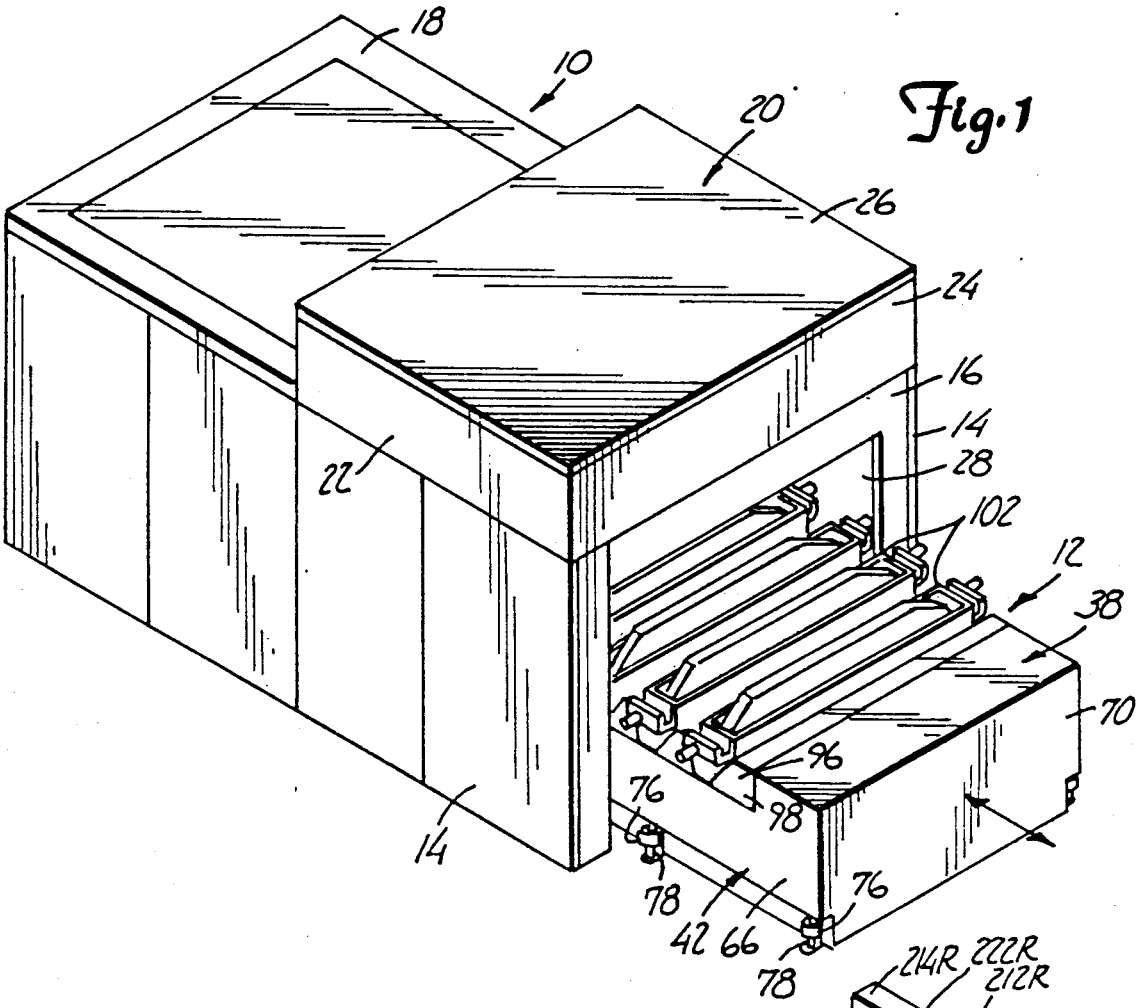
FIG. 1 is a perspective view of an electrographic printer that includes the drive system of the present invention.

An electrographic printer 10 which includes a drive system 2 in accordance with the present invention is illustrated generally in FIG. 1. The electrographic printer 10 includes a pair of side walls 14, a front end wall (not shown) and a rear end wall 16. The electrographic printer 10 further includes a lower top surface 18, and an upper section 20 formed by a pair of side walls 22 (only one of which is shown in FIG. 1), an end wall 24 and an upper top surface 26. An opening 28 is formed in the rear end wall 16 adjacent the upper structure 20 at a rear side of the electrographic printer 10.

Figure 2:
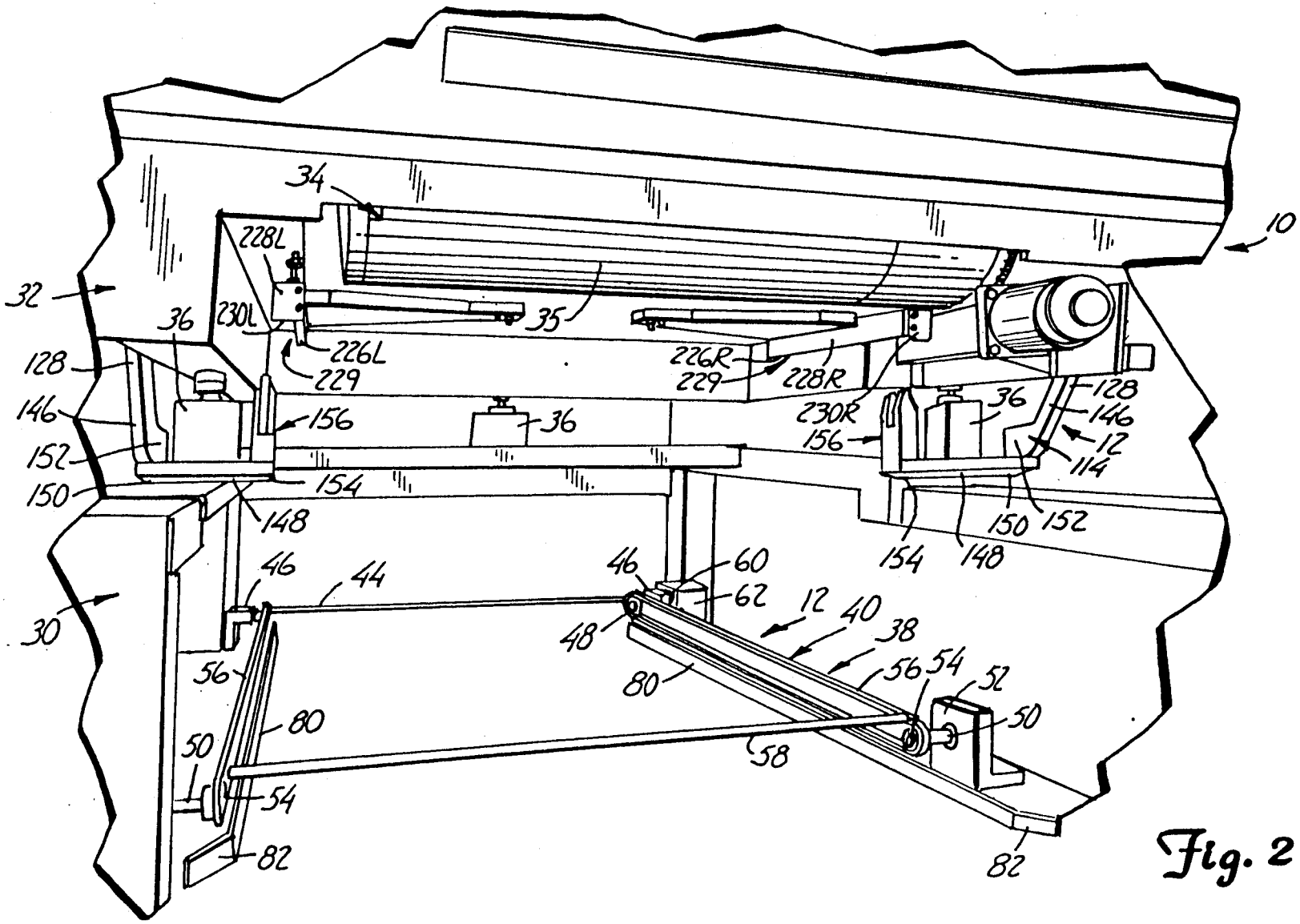
FIG. 2 is a perspective view of the interior of the electrographic printer as seen from the opening in the rear end wall showing details of the drive system.

As seen in FIG. 2, the electrographic printer 10 includes a lower main frame 30 configured to be supported on a floor surface and an upper main frame 32. The upper main frame 32 includes a photoconductive drum assembly 34 for producing multicolor prints. As seen in FIG. 2, the photoconductive drum assembly 34 includes a rotatable photoconductor drum 35. The upper main frame 32 is vibration isolated from the lower main frame 30 by three air bags 36. The air bags 36 help prevent floor vibrations (e.g., from equipment operating nearby) from reaching the upper main frame 32 through the lower main frame 30. Such vibrations if translated to the photoconductive drum assembly 34 could adversely affect the quality of the multicolor print produced by the photoconductor drum 35.

INDEXING ASSEMBLY

As seen in FIG. 2, an indexing assembly 38 that forms part of the drive system 12 is mounted on the lower main frame 38. The indexing assembly 38 includes a chain drive mechanism 40 configured to position a toner cart 42 (see FIG. 1) relative to the photoconductive drum assembly 34. The chain drive mechanism 40 includes a drive shaft 44 rotatably mounted to the lower main frame 30 through a pair of support mounts 46. Opposite ends of the drive shaft 44 include drive sprockets 48 (only one of which is clearly shown in FIG. 2). The drive mechanism 40 further includes a pair of idler shafts 50 disposed near the opening 28 of the electrographic printer 10. Idler shafts 50 are rotatably mounted to the lower main frame 30 by a pair of support mounts 52 (only one of which is shown in FIG. 2). Free ends of the idler shafts 50 include idler sprockets 54.

Corresponding drive sprockets 48 and idler sprockets 54 on the same side of the lower main frame 30 are coupled to rotate in unison by way of a continuous chain 56. One end of the drive shaft 44 is coupled to a drive gear 60 which in turn is driven by a stepper motor 62. A tow bar 58 extends between the continuous chains 56, so that as the stepper motor 62 powers the drive shaft 44, drive sprockets 48 and idler sprockets 54, the chains 56 move the tow bar 58 along the longitudinal extent of the lower main frame 30.

As seen in FIGS. 3–6, the toner cart 42 includes a base wall 64, a pair of spaced sidewalls 66, a front wall 68 and a rear wall 70 (see FIG. ). The toner cart 42 is supported for movement over a floor surface 72 by casters 74 secured to the base wall 64. Toner cart 42 further includes a plurality of guide rollers 76 that are mounted to the side walls 66. The guide rollers 76 are mounted so as to rotate about vertically oriented spindles 78, best shown in FIG. 3. The lower main frame 30 includes a pair of spaced guide rails 80 that are configured to be engaged by the guide rollers 76 to center the toner cart 42 within the electrographic printer 10. As seen in FIG. 2, the guide rails 80 include sloped guide portions 82 adjacent the opening 28 that help to initially center the toner cart 42 as it is inserted into the electrographic printer 10.

Figure 4:
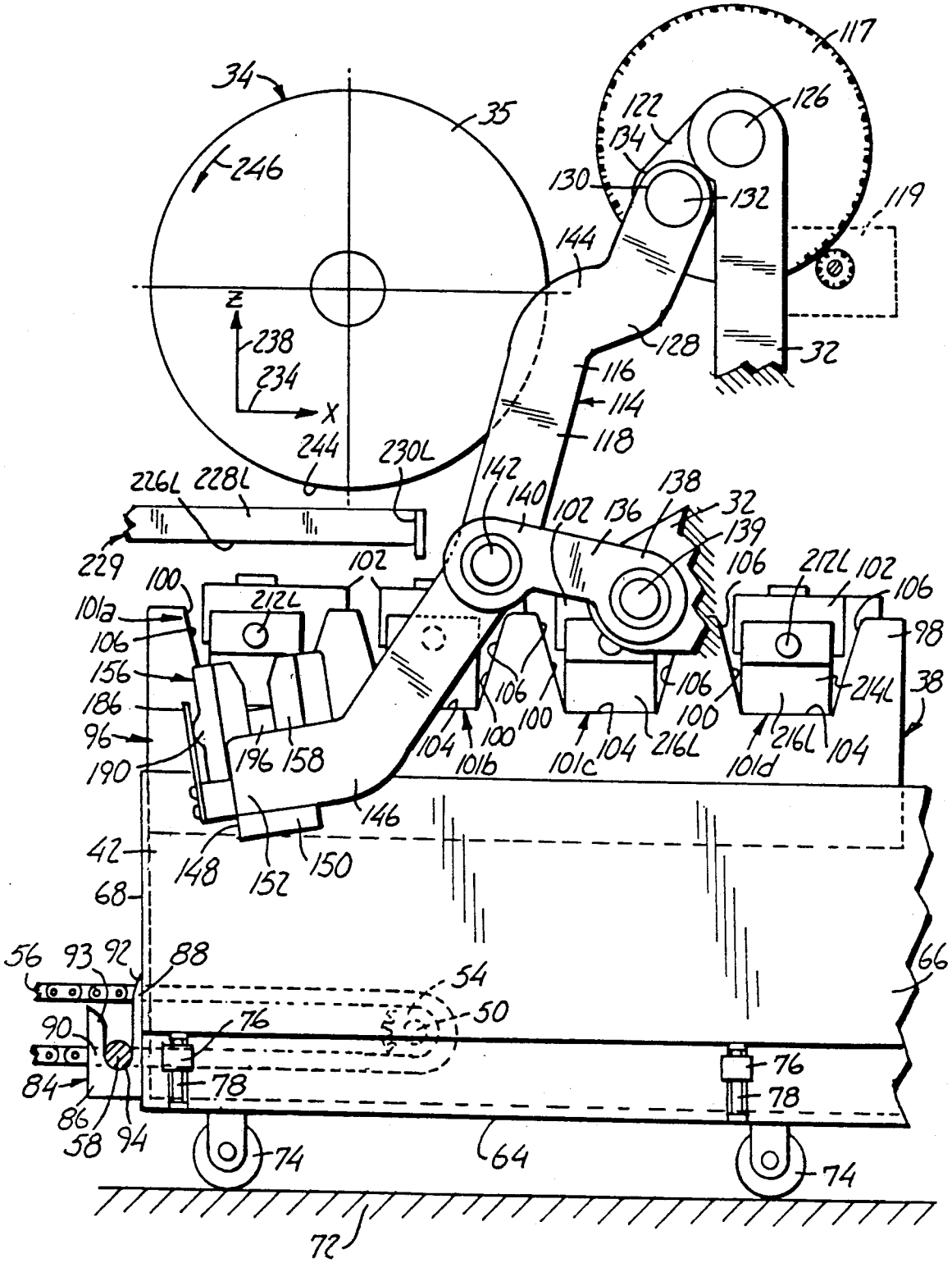
FIG. 4 is a side elevational view of the lift assembly in a position slightly below one of the developing modules.
Figure 5:
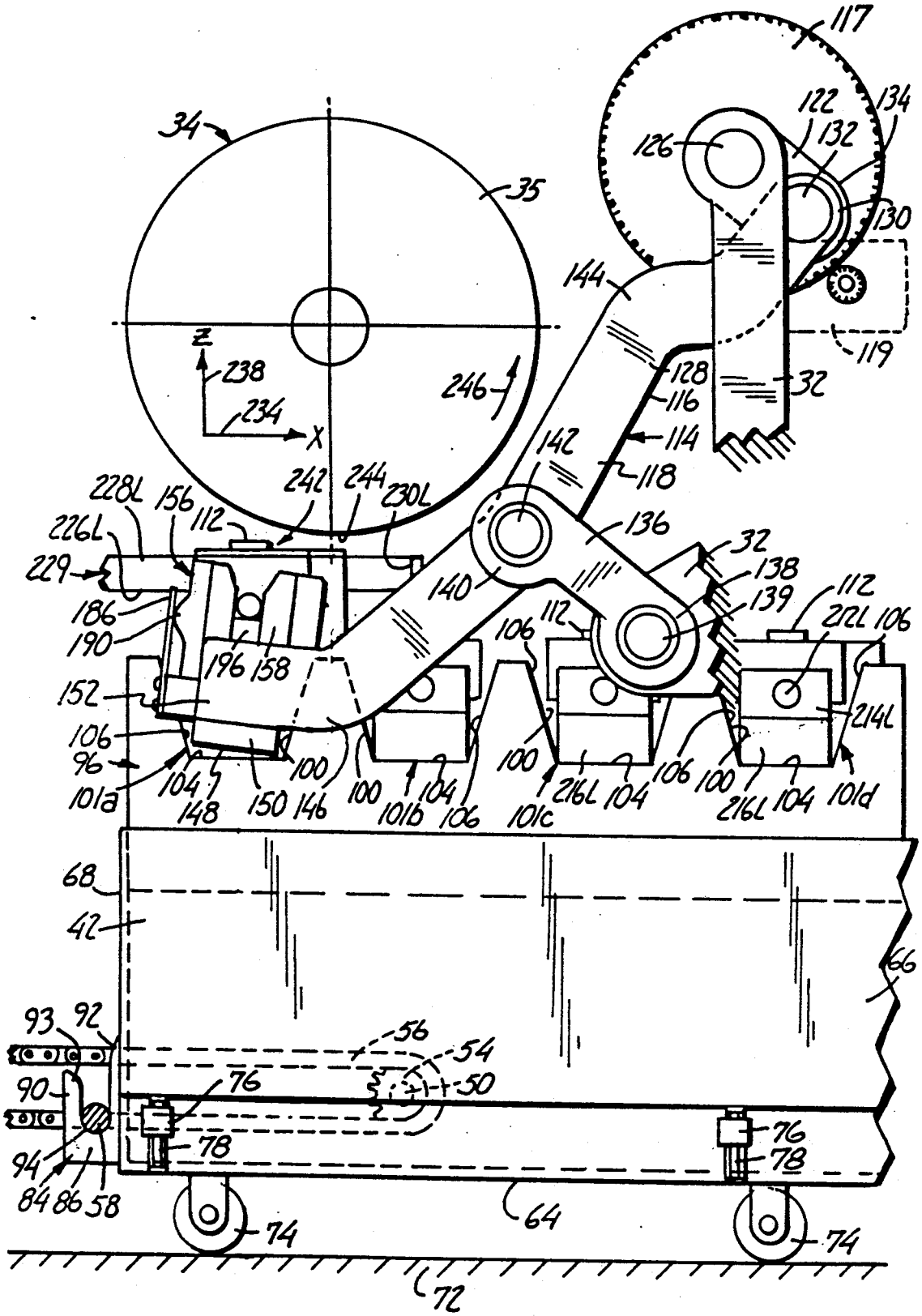
FIG. 5 is a side elevational view similar to FIG. 4 with the developing module lifted slightly off of the developer rack.
Figure 6:
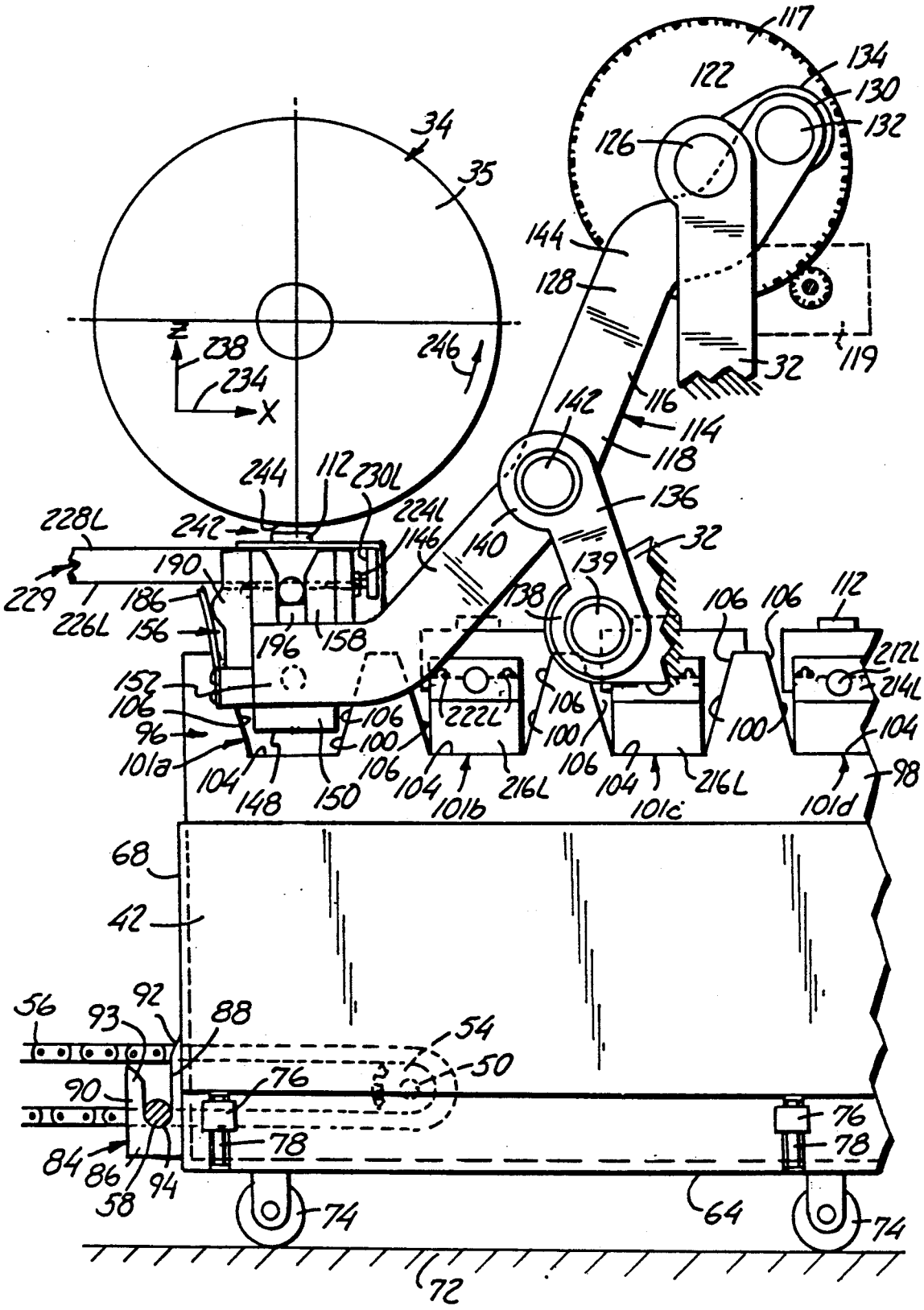
FIG. 6 is a side elevational view similar to FIG. 4 with the developing module in the vertically and horizontally gaped developing position.

The toner cart 42 further includes a toner cart hook 84 (see FIGS. 3–6). The toner cart hook 84 is U-shaped and includes a base portion 86, a long upstanding leg 88 rigidly attached to the front wall 68 of the toner cart 42, and a short upstanding leg 90 spaced from the long upstanding leg 88. Long and short upstanding legs 88 and 90 include guide surfaces 92 and 93, respectively, that form a smooth transition into a tow bar receiving notch 94 between the legs 88 and 90. As seen in FIGS. 4–6, the tow bar 58 (shown in section) is configured to engage the notch 94 of the toner cart hook 84 and thus, longitudinal movement of the tow bar 58 causes likewise movement of the toner cart 42 within the body of the electrographic printer 10. The guide surfaces 92 and 93 of the toner cart hook 84 act to direct the tow bar 58 into the notch 94.

As seen in FIGS. 3–6, the toner cart 42 is configured to support a removable developer rack 96. The developer rack 96 includes a pair of spaced, parallel side walls 98 which include a plurality of cutouts 100. The cutouts include a base portion 104 and a pair of angled side walls 106. Aligned pairs of cutouts 100 between the side walls 98 form support troughs **101*a*–101*d*. Each trough 101*a*–101*d* is configured to support a liquid toner developing module 102 (four such developing modules 102 being shown in FIGS. 3–6). However, the developer rack 96 could support up to six developing modules 102, with each module 102 supplying a different color of toner fluid. The angled side walls 106 of the cutouts 100 act as centering guide surfaces for the developing modules 102 as they are returned to the developer rack 96** subsequent to the developing process.

Figure 7:
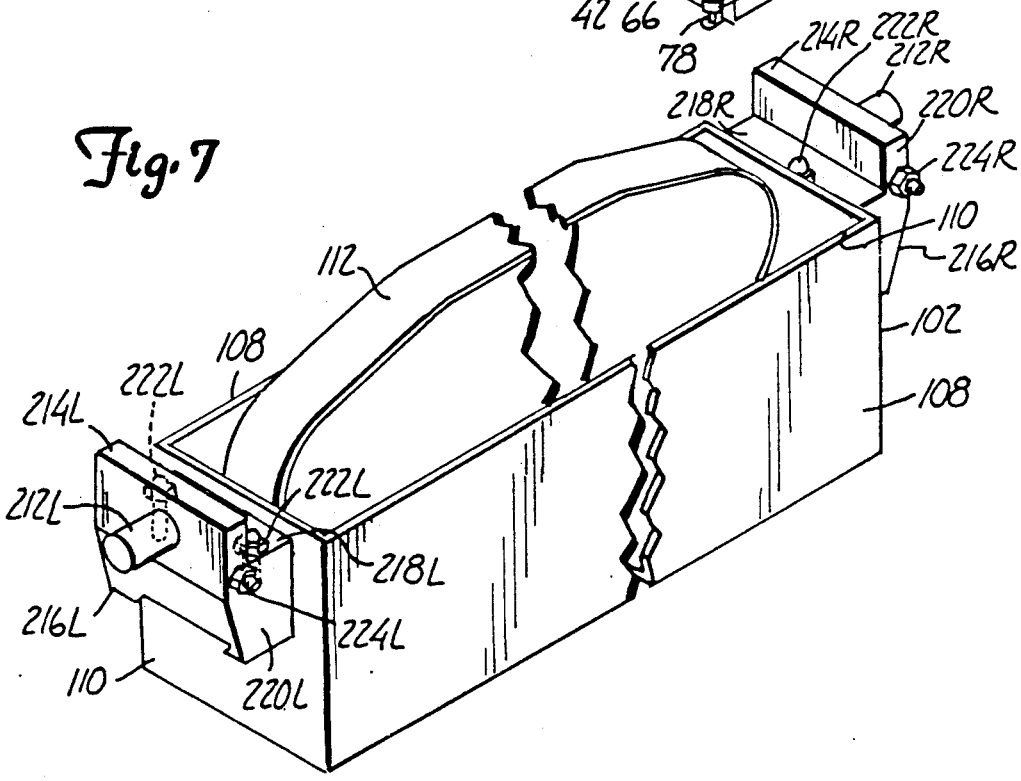
FIG. 7 is a perspective view of the developing module.

As seen in FIG. 7, each of the liquid toner developing modules 102 includes a base wall (not shown), a pair of spaced side walls 108 interconnected by a pair of end walls 110. Each of the developing modules 102 dispenses a different color of toner fluid (i.e., yellow, cyan, magenta and black) used during the developing process performed by the electrographic printer 10. Each of the developing modules 102 includes an electrode band 112 that is configured to carry a film of the toner fluid. The toner cart 42 is designed to hold the components necessary to supply toner fluid to each of the liquid toner developing modules 102. The toner cart 42 with the developing modules 102 thereon is designed to be a self contained unit so as to be removable from the electrographic printer 10 to add toner fluid and for routine maintenance.

LIFT ASSEMBLY

As seen in FIGS. 2 and 8, the upper main frame 32 further includes a lift assembly 114 that forms part of the drive system 12. Lift assembly 114 includes a pair of lift arms 116. The lift arms 116 are mirror images of one another and, therefore, only the lift arm 116 adjacent the left side of the printer 10 will be described with particularity. The lift arm 116 on the right side is otherwise identical. As seen in FIGS. 2–6, the lift arm 116 includes a four bar linkage 118. The four bar linkage 118 is defined by a drive link 122 that is attached at a first end 124 (FIG. 8) to a pivot rod 126 rotatably supported on the upper main frame 32. As seen in FIG. 8, the pivot rod 126 extends between the drive links 122 of both lift arms 116 to insure that they rotate in unison. The pivot rod 126 is coupled to a drive gear 117 which in turn is driven by a stepper motor 119. The stepper motor 119 powers the drive links 122 to move the four bar linkages 118 relative to the upper main frame 32.

A coupler link 128 is pivotally attached at a first end 130 by a pivot mount 132 to a second end 134 of the drive link 122. A follower link 136 is pivotally attached at a first end 138 by a pivot mount 139 to the upper main frame 32 at a point below the pivot rod 126. A second end 140 of the follower link 136 is pivotally attached by a pivot mount 142 to the median of the coupler link 128. Coupler link 128 includes a first S-shaped portion 144 that extends between the pivot mount 142 and the pivot mount 132, and a second L-shaped portion 146 that extends below the pivot mount 142. A spacer bar 148 is rigidly attached at a first end 150 to a second end 152 of the coupler link 128. As seen in FIG. 8, the spacer bar 148 is perpendicular to the coupler link 128 and extends toward the lift arm 116 on the other side of the printer 10.

HOOK ASSEMBLIES

Figures 9, 10:
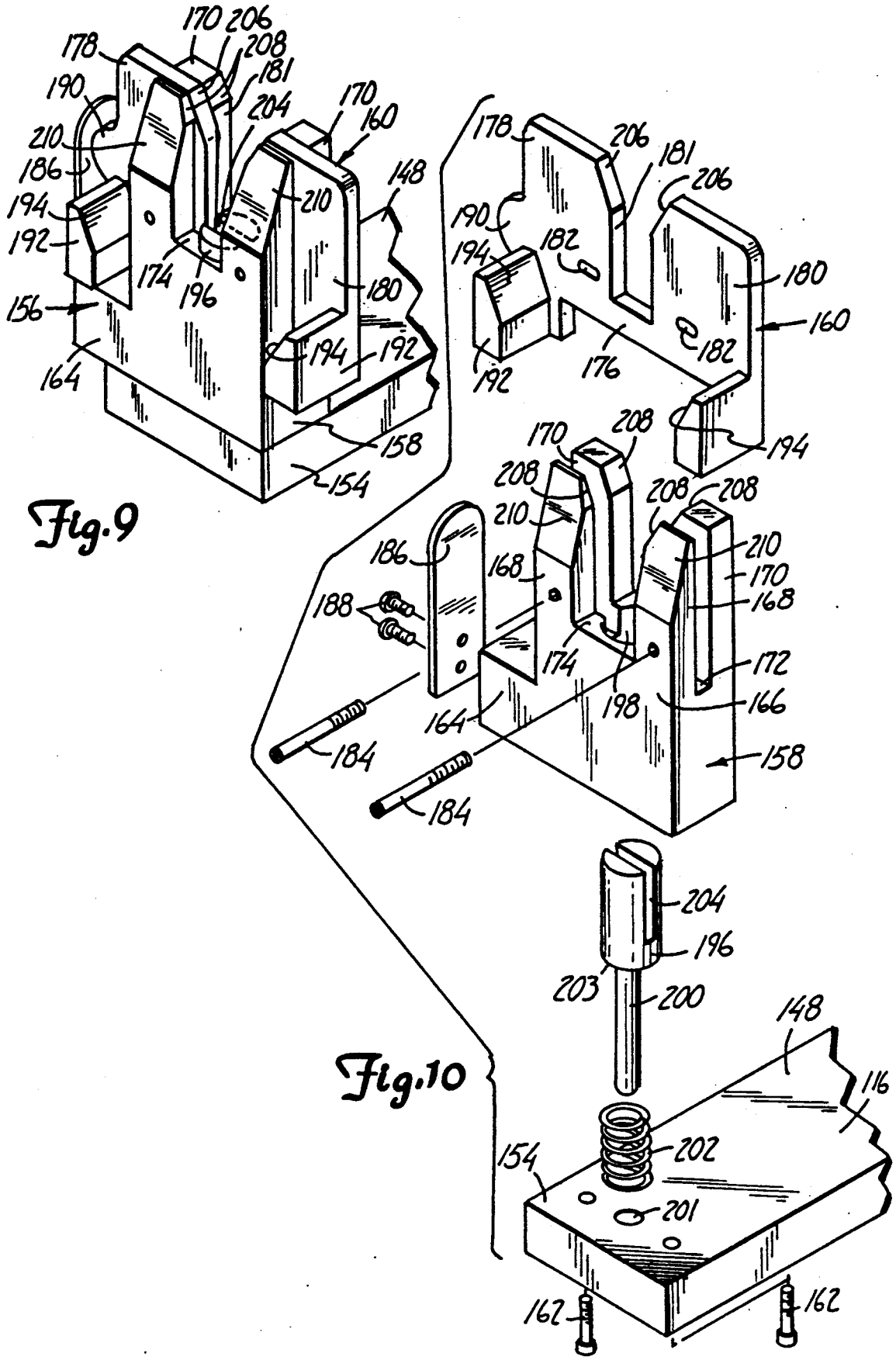
FIG. 9 is a perspective view of the hook assembly that forms part of the lift assembly.
FIG. 10 is an exploded perspective view of the hook assembly shown in FIG. 9.

As seen in FIG. 3, second ends 154 of the spacer bars 148 include hook assemblies 156. The hook assemblies 156 are mirror images of one another and, therefore, only the hook assembly 156 mounted to the lift arm 116 adjacent the right side of the printer 10 will be described with particularity. The hook assembly 156 adjacent the left side of the printer 10 is otherwise identical. As seen in FIGS. 9 and 10, hook assembly 156 includes a first centering member 158 and a second centering member 160 movably supported by the first centering member 158. First centering member 158 is attached to the second end 154 Of the spacer bar 148 by a pair of threaded fasteners 162 The first centering member 158 is generally L-shaped and includes a base leg portion 164 and an upstanding leg portion 166.

Upstanding leg portion 166 includes a pair of inner extensions 168 and a pair of outer extensions 170. A first longitudinal channel 172 for supporting the second centering member 160 for linear movement is formed between the pair of inner extensions 168 and the pair of outer extensions 170. The upstanding leg portion 166 further includes a second lateral channel 174 perpendicular to the first longitudinal channel 172.

The second centering member 160 is U-shaped as defined by a bight portion 176, a first leg portion 178 and a second leg portion 180. An elongated lateral channel 181 is formed between the first and second leg portions 178 and 180. As seen in FIG. 9, the elongated lateral channel 181 of the second centering member 160 is in aligned registry with the second lateral channel 174 of the first centering member 158. The first and second leg portions 178 and 180 further include longitudinal guide slots 182. A pair of spring pins 184 extend into the pair of inner extensions 168 of the first centering member 158, through the longitudinal guide slots 182 and are press fit into openings (not shown) in the pair of outer extensions 170 of the first centering member 158. The guide slots 182 allow the second centering member 160 to move linearly within the first longitudinal channel 172. A leaf spring element 186 attached by fasteners 188 to the base leg portion 164 of the first centering member 158 engages a rounded portion 190 of the first leg portion 178 to bias the second centering member 160 along the first longitudinal channel 172 toward the opening 28 in the electrographic printer 10. The second centering member 160 further includes a pair of laterally extending positioning ears 192 having inclined guide surfaces 194.

A peg 196 is movably supported in an opening 198 formed at the junction of the first and second channels 172 and 174. The peg 196 includes a stem 200 received in an aperture 201 formed in the second end 154 of the spacer bar 148. A coil spring member 202 carried within the opening 198 biases the peg 196 upwardly relative to the first centering member 158. The coil spring 202 surrounds the stem 200 and acts between the second end 154 of the spacer bar 148 and a shoulder portion 203 of the peg 196 to bias the peg 196 upwardly. The peg 196 includes a longitudinal groove 204 that receives the bight portion 176 of the second centering member 160 so as to permit free movement of the second centering member 160 relative to the peg 196, and further allow free upward movement of the peg 196 relative to the first centering member 158. First and second leg portions 178 and 180 include beveled guide surfaces 206 directed towards the elongated lateral channel 181. The pair of inner and outer extensions 168 and 170 also include beveled guide surfaces 208 directed towards the second lateral channel 174. The pair of inner extensions 168 further include slanted guide surfaces 210 adjacent the beveled guide surfaces 208 and second lateral channel 174.

As seen in FIG. 3, the hook assemblies 156 are configured to receive lift pins 212L and 212R mounted on the developing modules 102. As seen in FIG. 7, the lift pins 212L and 212R form part of developer ends 214L and 214R, respectively, secured to the end walls 110 of the modules 102. The developer ends 214L and 214R include ramped guide surfaces 216L and 216R, respectively, that coact with the slanted guide surfaces 210 of the first centering members 158 to center the developing module 102 therebetween. The developer ends 214L and 214R include first support portions 218L and 218R and second support portions 220L and 220R. The first support portion 218L includes a pair of adjustable, vertical gaping pins 222L while the first support portion 218R includes only one adjustable, vertical gaping pin 222R. The second support portions 220L and 220R include adjustable, horizontal gaping pins 224L and 224R, respectively. The gaping pins 222L, 222R, 224L and 224R are threadably received in the developer ends 214L and 214R and are therefore adjustable.

The vertical gaping pins 222L and 222R are configured to engage substantially horizontal, first gaping surfaces 226L and 226R of a pair of gaping cams 228L and 228R, respectively. The gaping cams 228L and 228R are mounted to the upper main frame 32 adjacent the photoconductor drum 35 (see FIGS. 2–6) and define gaping cam mechanism 229. The first gaping surfaces 226L and 226R establish the pre-developing position of the developing modules 102 relative to the photoconductor drum 35. In addition, the first gaping surfaces 226L and 226R establish the vertical gap clearance between the electrode bands 112 of the modules 102 and the drum 35 needed for the developing process when the modules 102 are moved into the developing position. Moreover, the adjustable, vertical gaping pins 222L and 222R form a plane that insures that the modules 102 are level when engaged with the first gaping surfaces 226L and 226R, respectively. The horizontal gaping pins 224L and 224R are configured to engage substantially vertical, second gaping surfaces 230L and 230R, respectively of the gaping cams 228L and 228R to define a horizontally gaped position of the modules 102. The horizontally gaped position corresponds to the developing position of the developing modules 102. The horizontal gaping pins 224L and 224R further insure that the modules 102 are parallel to the longitudinal extent of the photoconductor drum 35 when the modules 102 are in the developing position.

OPERATION OF THE PREFERRED EMBODIMENT

The toner cart 42 with the developing modules 102 supported by the toner rack 96 is manually inserted into the electrographic printer 10 through the opening 28 in the rear end wall 16. The toner cart 42 contains the components necessary to supply liquid toner to the individual developing modules 102 and includes casters 74 that allow the toner cart 42 to be wheeled away from the printer 10 to add toner fluid and for maintenance. As the toner cart 42 is pushed through the opening 28 the guide rollers contact the sloped guide portions 82 to center the toner cart 42 between the lift arms 116. Pushing the toner cart 42 further into the printer 10 causes the guide rollers 76 to ride along the guide rails 80 until the toner cart hook 84 is adjacent the idler sprockets 50 of the chain drive mechanism 40.

The stepper motor 62 of the chain drive mechanism 40 is then actuated to move the tow bar 58 into engagement with the tow bar receiving notch 94 of the toner cart hook 84. Once the tow bar 58 is engaged with the hook 84, continued actuation of the stepper motor 62 (in the same direction) draws the toner cart 42 further within the printer 10. The stepper motor 62 ceases operation when the developing module 102 supported within the trough **101*a* is positioned directly above the hook assemblies 156 (see FIG. 4**).

The stepper motor 119 of the lift assembly 114 is then actuated to raise the lift arms 116. As the arms 116 move upwardly the lift pins 212L and 212R are simultaneously received in the second lateral channels 174 of the first centering members 158 and the elongated lateral channels 181 of the second centering members 160 (see FIG. 5). The lift pins 212L and 212R are supported primarily on the spring biased pegs 196 as the module 102 is moved out of the stored position. Once the module 102 is moved out of the stored position it becomes part of the vibrationally isolated upper main frame 32 to which the photoconductive drum assembly 34 is mounted. The beveled surfaces 206 and 208 provide pickup positioning latitude in the X-axis 234 (see FIG. 8) if the module 102 is misaligned with respect to the hook assemblies 156 of the lift arms 116, and act to guide the lift pins 212L and 212R into the hook assemblies 156. Coaction of the ramped guide surfaces 216L and 216R with the slanted guide surfaces 210 provide module 102 pickup positioning latitude in the Y-axis 236 (see FIG. 8) and act to center the module 102 between the lift arms 116. In the Z-axis 238 (see FIG. 8) motion of the lift arms 116 due to the four bar linkages 118 provides developing module 102 pickup positioning latitude. The inclined guide surfaces 194 of the positioning ears 192 provide rotational positioning latitude about the longitudinal axis as defined by the lift pins 212L and 212R and can be engaged by the developer ends 214L and 214R to limit rotation of the module 102.

As the lift arms 116 are raised the vertical gaping pins 222L and 222R contact the first gaping surfaces 226L and 226R, respectively of the gaping cams 228L and 228R. The module 102 is now in a vertically gaped pre-developing position and the proper vertical clearance gap 242 (see FIGS. 5 and 6) between the electrode band 112 of the module 102 and the imaging surface 244 of the photoconductor drum 35 needed for the developing process is established. The vertical clearance gap 242 is measured along the Z-axis 238 as viewed in FIGS. 4–6. When the vertical gaping pins 222L and 222R are engaged with the first gaping surfaces 226L and 226R, the pegs 196 biased by coil springs 202 act as an overdrive mechanism and allow the lift arms 116 to overdrive the pre-developing position and still preserve the needed vertical clearance gap 242. The module 102 is held in the pre-developing position until the developing process is set to commence. Further actuation of the stepper motor 119 causes the lift arms 116 to sweep the module 102 longitudinally along the first gaping surfaces 226L and 226R. The overdrive mechanism provided by the spring biased pegs 196 allows the vertical gaping pins 222L and 222R to remain in contact with the first gaping surfaces 226L and 226R as the module 102 is moved along the first gaping surfaces 226L and 226R toward the developing position.

During this sweep-in the photoconductor drum 35 rotates counterclockwise as viewed in FIGS. 4–6 and represented by arrow 246. In addition, liquid toner is supplied to a leading edge of the electrode band 112 to flow across the band 112 in the same direction as the module 102 is moving during the sweep-in. Toner is removed from a trailing edge of the band 112 by a vacuum force that provides a skiving action. The sweep-in motion, the skiving action and same relative motion of the photoconductor drum 35 and the liquid toner allows the toner to be presented to the drum 35 in a gradual manner. This arrangement decreases the likelihood of air bubbles being trapped in the liquid toner and ensures that the toner is presented to the clearance gap 242 in a consistent manner. As a result, the likelihood that the image produced by the developing process will be distorted is significantly reduced.

Adjacent the photoconductor drum 35, the horizontal gaping pins 224L and 224R contact the second gaping surfaces 230L and 230R, respectively of the gaping cams 228L and 228R. As seen in FIG. 6, the module 102 is now in the horizontally gaped developing position as measured along the X-axis 234. When the horizontal gaping pins 224L and 224R are engaged with the second gaping surfaces 230L and 230R, the second centering members 160 biased by leaf springs 186 act as an overdrive mechanism and allow the lift arms 116 to overdrive the developing position and still maintain the module 102 in engagement with the second gaping surfaces 230L and 230R. In the developing position the module 102 is simultaneously horizontally and vertically gaped. The module 102 is held in the developing position to effectuate the developing process, wherein toner fluid supplied by the module 102 is deposited on the imaging surface 244 of the photoconductor drum 35 as the drum 35 rotates. As seen in FIG. 6, the electrode band 112 in the developing position is generally normal to the radius of the photoconductor drum 35.

After the developing process for this module 102 ends, the stepper motor 119 is actuated in the opposite direction. The lift arms 116 move the module 102 away from the developing position along the first gaping surfaces 226L and 226R back to the pre-developing position. This sweep-out movement of the module 102 along the first gaping surfaces 226L and 226R is slower than the sweep-in movement since the motion of the module 102 as it moves along the first gaping surfaces 226L and 226R is opposite the relative motion of the rotating photoconductor drum 35. During the sweep-out the skiving action provided by the vacuum force removes excess liquid toner from the imaging surface 244 of the drum 35. As a result, the likelihood that the image produced by the developing process will be distorted is further reduced.

Continued actuation of the stepper motor 119 causes the lift arms 116 to lower the module 102 back to its stored position in the trough 101*a* of the developer rack 96. The lift arms 116 continue to lower until they are below the module 102 (as shown in FIG. 4), with the hook assemblies 156 fully under and clear of the lift pins 212L and 212R. The angled side walls 106 of the aligned pairs of cutouts 100 that form the trough 101*a* provide positioning latitude for the module 102 in the X-axis 234. The angled side walls 106 further help to center the module 102 back into the trough 101*a* as it is returned to the stored position. During any raising or lowering of the lift arms 116, the stepper motor 62 of the chain drive mechanism 40 operates in a synchronized manner with the stepper motor 119 of the lift arms 116 to move the toner cart 42 and prevent the module 102 and hook assemblies 156 from colliding with adjacent portions of the developing rack 96 or other modules 102.

Any time the module 102 is engaged with the first gaping surfaces 226L and 226R (FIGS. 5 and 6) the spring biased pegs 196 act as overdrive mechanisms and compensate for the path of movement of the hook assemblies 156 due to the four bar linkages 118. When the module 102 is engaged with the second gaping surfaces 230L and 230R (FIG. 6), the leaf spring biased second centering elements 160 act as overdrive mechanisms and compensate for the path of movement of the hook assemblies 156 due to the four bar linkages 118.

Once one module 102 has been cycled through the developing process, the stepper motor 62 is again actuated to draw the toner cart 42 further into the printer 10 until the lift pins 212L and 212R of the next module 102, supported within the through 101*b*, are positioned directly above the hook assemblies 156. This module 102 is then moved between the stored position and the developing position and back to the stored position in the same way as the previous module 102. This process is repeated for all the modules 102 until the entire developing process for the multicolor print is completed. If at any time the developing modules 102 have to be replenished with liquid toner or maintenance needs to be performed, the stepper motor 62 is actuated to push the toner cart 42 towards the opening 28. This action disengages the tow bar 58 from the toner cart hook 84, thereby allowing the toner cart 42 to be manually pulled the rest of the way out of the electrographic printer 10.

This drive system 12 is relatively uncomplicated and the first gaping surfaces 226L and 226R and second gaping surfaces 230L and 230R of the gaping cams 228L and 228R, respectively, allow precise positioning of the developing modules 102 in both horizontal and vertical axes without contacting the photoconductor drum 35. Since the developing modules 102 do not contact the photoconductor drum 35, the likelihood that the image produced by the developing process will be distorted is significantly reduced. In addition, the overdrive mechanisms provided by the pegs 196 and the second centering members 160 allow latitude in the positioning of the drive system components, while maintaining the precise gap clearance required between the developing module 102 and the photoconductor drum 35 for the developing process. Moreover, the positioning assemblies of this drive system 12 compensate for inaccuracies in the drive system components which may cause pickup misalignment between the developing module 102 and the hook assemblies 156. Specifically, the components are dimensioned so that the coaction between the slanted guide surfaces 210 of the first centering members 158 and the ramped guide surfaces 216L and 216R of the developer ends 214L and 214R provides approximately ±3 mm of developing module 102 pickup positioning latitude in the transverse direction (i.e., Y-axis 236) of the printer 10. The beveled guide surfaces 206 and 208 of the first and second centering members 158 and 160, respectively, provides approximately ±6 mm of developing module 102 pickup positioning latitude in the longitudinal direction (i.e., X-axis 234) of the printer 10. In the vertical direction (i.e., Z-axis 238) motion of the lift arms 116 due to the four bar linkages 118 provides approximately ±12 mm of developing module 102 pickup positioning latitude. Lastly, the coaction of the inclined guide surfaces 194 of the positioning ears 192 with the developer ends 214L and 214R limit the developing modules 102 to approximately ±15° of rotational freedom about the longitudinal axis of the developing modules 102 as defined by the lift pins 212L and 212R. Such close tolerances and highly accurate positioning of the toner developing modules 102 relative to the rotating photoconductor drum 35 are essential for quality image development and transfer.

Although the present invention has been described with reference to preferred embodiments, workers skilled in the art will recognize that changes may be made in form and detail without departing from the spirit and scope of the invention.

What is claimed is:

1. A drive system for positioning any one of a plurality of liquid toner developing modules relative to a photoconductor mounted to a frame, comprising:

an indexing assembly, including:

a toner cart positioned below the photoconductor for supporting the plurality of developing modules, the toner cart being movable relative to the frame; and a movable lift assembly mounted to the frame adjacent to the photoconductor and above the developing modules, the lift assembly being configured to releasably engage any one of the plurality of developing modules and raise the module away from the toner cart to a developing position adjacent the photoconductor to effectuate a developing process.

2. The drive system of claim 1 wherein the indexing assembly further includes:

a drive mechanism for releasably engaging the toner cart to move the cart relative to the frame so as to position any one of the plurality of developing modules for engagement by the lift assembly.

3. The drive system of claim 2 wherein the toner cart includes a developer rack having a plurality of troughs for supporting the plurality of developing modules, and wherein the drive mechanism moves the cart during movement of the lift assembly to prevent the module engaged by the lift assembly from colliding with the developer rack or other modules supported on the rack.

4. The drive system of claim 1, and further including:

a gaping cam mechanism mounted to the frame adjacent the photoconductor, including:

a first gaping surface configured to be engaged by the module as the module is moved away from the toner cart by the lift assembly, to establish a pre-developing position wherein a needed gap clearance between the module and the photoconductor is established, the lift assembly being configured to move the module along the first gaping surface toward the developing position.

5. The drive system of claim 4 wherein the gaping cam mechanism further includes:

a second gaping surface configured to be engaged by the module as the module is moved away from the pre-developing position by the lift assembly to establish the developing position of the module.

6. The drive system of claim 5 wherein the lift assembly includes:

a pair of spaced lift arms pivotally mounted to the frame, the lift arms including hook assemblies configured to releasably engage opposite ends of the developing modules.

7. The drive system of claim 6 wherein each hook assembly includes:

a first centering member; and a second centering member slidably supported on the first centering member, the second centering member allowing the lift arms to overdrive the developing position and still maintain the module in engagement with the second gaping surface of the gaping cam mechanism.

8. The drive system of claim 7 wherein each hook assembly further includes:

a spring element mounted between the first and second centering members and configured to bias the second centering member towards the second gaping surface so that the lift arms overdrive the developing position against the bias of the spring element.

9. The drive system of claim 8 wherein each hook assembly further includes:

a peg slidably supported by the first centering member, the peg being configured to support the respective end of the module and allow the lift arms to overdrive the predeveloping position and still preserve the needed gap clearance between the module engaged by the lift assembly and the photoconductor.

10. The drive system of claim 9 wherein each hook assembly further includes:

a spring member carried by the first centering member and configured to bias the peg towards the first gaping surface so that the lift arms overdrive the predeveloping position against the bias of the spring member.

11. The drive system of claim 1, and further including:

a vibration dampener mounted to the frame for isolating the photoconductor and lift assembly from vibrations, and wherein the module engaged by the lift assembly is also isolated from vibrations once the module is moved away from the toner cart.

12. A drive system for positioning a liquid toner developing module relative to a photoconductor mounted to a frame, comprising:

a developer rack positioned below the photoconductor for supporting the developing module; and a lift assembly mounted to the frame adjacent to the photoconductor and above the developing module, including:

a first lift arm movably mounted to the frame, including;

a first hook assembly mounted on the first lift arm for releasably engaging the developing module to allow the first lift arm to move the module between a stored position wherein the module is supported on the rack to a developing position adjacent the photoconductor to effectuate a developing process, wherein the developing position is elevated relative to the stored position; and a motor assembly for moving the first lift arm relative to the frame.

13. The drive system of claim 12 wherein the first lift arm includes:

a first linkage assembly defined by a first drive link pivotally attached at a first end to the frame, a first coupler link pivotally attached at a first end to a second end of the first drive link, and a first follower link pivotally attached at a first end to the frame and at a second end to a median of the first coupler link, and wherein the first hook assembly is mounted to a second end of the first coupler link.

14. The drive system of claim 13 wherein the lift assembly further includes:

a second lift arm movably mounted to the frame and spaced from the first lift arm, including:

a second linkage assembly defined by a second drive link pivotally attached at a first end to the frame, a second coupler link pivotally attached at a first end to a second end of the second drive link, and a second follower link pivotally attached at a first end to the frame and at a second end to a median of the second coupler link;

a second hook assembly mounted to a second end of the second coupler link, and wherein the first and second hook assemblies releasably engage first and second ends, respectively of the developing module, allowing the first and second lift arms to move the module between the stored position and the developing position.

15. The drive system of claim 14, and further including:

a pivot rod pivotally mounted to the frame and including first and second opposite ends, and wherein the first and second drive links are rigidly mounted to the first and second ends, respectively, of the pivot rod so that the first and second lift arms operate in unison.

16. The drive system of claim 15 wherein the motor assembly includes:

a drive gear rigidly mounted to the first drive link; and a stepper motor mounted to the frame for driving the drive gear and moving the lift assembly with the module supported thereon between the stored position and the developing position.

17. The drive system of claim 14 wherein the first and second linka~~ assemblies further include:

first and second spacer bars mounted between the second ends of the first and second coupler links and the first and second hook assemblies, respectively.

18. The drive system of claim 14 wherein each hook assembly includes:

a first centering member mounted to the respective coupler link and including a first channel; and a second centering member slidably supported in the first channel of the first centering member.

19. The drive system of claim 18 wherein the first centering member further includes a second channel perpendicular to the first channel, and wherein the second centering member includes an elongated channel that is in aligned registry with the second channel of the first centering member.

20. The drive system of claim 19 wherein the first and second ends of the developing module include first and second lift pins, respectively, that are configured to be releasably received in the aligned second and elongated channels of the first and second hook assemblies, respectively when the module is being moved away from the stored position by the lift assembly.

21. The drive system of claim 20 wherein each of the second centering members includes:

a pair of spaced positioning ears extending outwardly therefrom that are configured to engage the respective ends of the developing module to limit rotation of the module once the module is moved away from the stored position.

22. The drive system of claim 20 wherein each of the first centering members includes a slanted guide surface, and wherein the first and second ends of the developing module include ramped guide surfaces that coact with respective slanted guide surfaces to center the module between the first and second lift arms once the module is moved away from the stored position.

23. The drive system of claim 20 wherein the second channel and the elongated channel include beveled guide surfaces that direct the first and second lift pins of the module into the second and elongated channels of the first and second hook assemblies, respectively, as the module is moved away from the stored position.

24. The drive system of claim 20, and further including:

a pair of spaced gaping cams mounted to the frame adjacent the photoconductor, including:

first gaping surfaces configured to be engaged by the module as the module is moved away from the stored position, to establish a predeveloping position wherein a needed gap clearance between the module and the photoconductor is established, the lift assembly being configured to move the module along the first gaping surface toward the developing position.

25. The drive system of claim 24 wherein the first and second ends of the module each include first support portions that are configured to engage the first gaping surfaces of the gaping cams.

26. The drive system of claim 25 wherein the first support portion of the first end includes a pair of spaced, adjustable vertical gaping pins and the first support portion of the second end includes a single, adjustable vertical gaping pin, the vertical gaping pins being configured to engage the first gaping surfaces.

27. The drive system of claim 24 wherein the pair of gaping cams further include:

second gaping surfaces that are configured to be engaged by the module as the module is moved away from the pre-developing position to establish the developing position of the module.

28. The drive system of claim 27 wherein the first and second ends of the module each include second support portions that are configured to engage the second gaping surfaces of the gaping cams in the developing position of the module.

29. The drive system of claim 28 wherein the second support portions of the firs&. and second ends each include an adjustable horizontal gaping pin, the horizontal gaping pins being configured to engage the second gaping surfaces.

30. The drive system of claim 27 wherein each hook assembly further includes:

a leaf spring element mounted between the first and second centering members and configured to bias the second centering member towards the respective second gaping surface so that the lift arms overdrive the developing position against the bias of the leaf spring element.

31. The drive system of claim 24 wherein each hook assembly further includes:

a peg slidably supported by the first centering member, and wherein the peg supports the respective lift pin and allows the lift arms to overdrive the pre-developing position and still preserve the needed gap clearance between the module and the photoconductor.

32. The drive system of claim 31 wherein each hook assembly further includes:

a coil spring member carried by the first centering member and configured to bias the peg towards the respective first gaping surface so that the lift arms overdrive the pre-developing position against the bias of the coil spring member.

33. A drive system of claim 12 wherein the developing module includes a plurality of developing modules, and wherein the developer rack includes a plurality of troughs for supporting the plurality of developing modules.

34. The drive system of claim 33, and further including:

an indexing assembly, including:

a toner cart movable relative to the frame and configured to support the developer rack.

35. The drive system of claim 34 wherein the indexing assembly further includes:

a drive mechanism for releasably engaging the toner cart to move the cart relative to the frame so as to position any one of the plurality of developing modules for engagement by the lift assembly.

36. The drive system of claim 35 wherein the drive mechanism includes:

a first drive shaft mounted to the frame and including drive sprockets mounted on first and second ends thereof;

first and second spaced idler shafts mounted to the frame, each idler shaft including an idler sprocket;

a first endless chain linking the drive sprocket on the first end of the drive shaft to the idler sprocket on the first idler shaft;

a second endless chain linking the drive sprocket on the second end of the drive shaft to the idler sprocket on the second idler shaft;

a tow bar parallel with the drive shaft and coupled between the chains for releasably engaging the toner cart; and a motor associated with the drive shafts for rotating the chains and thereby moving the toner cart relative to the frame so as to position any one of the plurality of developing modules for engagement by the lift assembly.

37. An indexing assembly for positioning any one of a plurality of developing modules for engagement by a lift assembly mounted to a frame, comprising:

a toner cart movable relative to the frame and configured to support the plurality of developing modules, the toner cart including a toner cart hook; and a drive mechanism including a tow bar for releasably engaging the toner cart hook, the drive mechanism when the tow bar is engaged with the toner cart hook being configured to move the toner cart relative to the frame so as to position any one of the plurality of developing modules for engagement by the lift assembly, and the drive mechanism when the tow bar is disengaged from the toner cart hook allowing the toner cart to be removed from the frame.

38. The indexing system of claim 37 wherein the drive mechanism includes:

a first drive shaft mounted to the frame and including drive sprockets mounted on first and second ends thereof;

first and second spaced idler shafts mounted to the frame, each idler shaft including an idler sprocket;

a first endless chain linking the drive sprocket on the first end of the drive shaft to the idler sprocket on the first idler shaft;

a second endless chain linking the drive sprocket on the second end of the drive shaft to the idler sprocket on the second idler shaft, wherein the tow bar is parallel with the drive shaft and coupled between the first and second endless chains; and a motor associated with the drive shafts for rotating the chains and thereby moving the toner cart relative to the frame when the tow bar is engaged with the toner cart hook so as to position any one of the plurality of developing modules for engagement by the lift assembly.

39. For use with an electrographic printer of the type including a photoconductor for carrying out a developing process and a plurality of toner developing modules supported on a movable developer rack; a method for moving a selected developing module between a stored position wherein the selected module is supported on the developer rack to a developing position adjacent the photoconductor to effectuate the developing process, including:

providing the printer with a gaping cam mechanism and a motor driven lift assembly having a hook assembly mounted thereto;

positioning the developer rack relative to the lift assembly with the selected module adjacent the hook assembly;

actuating the lift assembly in a first direction to move the hook assembly relative to the photoconductor;

engaging the hook assembly with opposite ends of the selected module;

further actuating the lift assembly in the first direction to lift the selected module off of the rack and into engagement with a first gaping surface of the gaping cam mechanism to define a pre-developing position and establish a needed vertical gap between the photoconductor and the selected module;

holding the selected module in the vertically gaped pre-developing position until the developing process is ready to commence;

further actuating the lift assembly in the first direction to move the selected module along the first gaping surface;

stopping the lift assembly when the module engages a second gaping surface of the gaping cam mechanism to define the developing position adjacent the photoconductor wherein the module is horizontally gaped; and holding the selected developing module in the horizontally gaped developing position to effectuate the developing process.

40. The method of claim 39 wherein:

the developer rack is mounted on and movable with a toner cart that can be readily inserted into and removed from the electrographic printer, and the printer further includes a motor driven indexing assembly having a tow bar; and positioning the developer rack relative to the lift assembly includes:

manually inserting the toner cart with the developer rack supported thereon into the printer;

actuating the indexing assembly in a first direction to position the tow bar adjacent a toner cart hook mounted to the toner cart;

engaging the tow bar of the indexing system with the toner cart hook;

further actuating the indexing assembly in the first direction to draw the toner cart further within the printer; and stopping the indexing assembly when the selected module supported on the developer rack is adjacent the hook assembly.

41. The method of claim 40 wherein further actuating the lift assembly in the first direction to lift the selected module off of the developer rack and into engagement with the first gaping surface of the gaping cam mechanism includes:

actuating the indexing system in a second direction so that the developer rack and toner cart move with the lift assembly to prevent the hook assembly and the selected module from colliding with the developer rack or the developing modules.

42. The method of claim 41 wherein further actuating the lift assembly in the first direction to move the selected toner developer along the first gaping surface of the gaping cam mechanism includes:

further actuating the indexing system in the second direction so that the developer rack and toner cart move with the lift assembly to prevent the hook assembly and the selected module from colliding with the developer rack or other developing modules.

43. The method of claim 42 and further including a method for moving the selected developing module between the developing position wherein the selected module is positioned adjacent the photoconductor and the stored position wherein the selected module is supported on the developer rack, including:

actuating the lift assembly in a second direction to move the selected module away from the developing position back along the first gaping surface until the selected module reaches the pre-developing position;

further actuating the lift assembly in the second direction to move the selected module away from the pre-developing position and lower the selected module on to the developer rack;

disengaging the hook assembly from the opposite ends of the selected module so that the selected module is in the stored position;

further actuating the lift assembly in the second direction to move the hook assembly relative to the photoconductor away from the selected module; and moving the developer rack relative to the lift assembly so that the selected module is spaced from the hook assembly.

44. The method of claim 43 wherein moving the developer rack relative to the lift assembly includes:

actuating the indexing system in the second direction to push the toner cart away from the lift assembly;

disengaging the tow bar of the indexing system from the toner cart hook;

further actuating the indexing system in the second direction to move the tow bar away from the toner cart hook; and manually removing the toner cart from the electrographic printer.

45. The method of claim 43 wherein actuating the lift assembly in the second direction to move the selected module away from the developing position back along the first gaping surface of the gaping cam mechanism includes:

actuating the indexing system in the first direction so that the developer rack and toner cart move with the lift assembly to prevent the hook assembly and the selected module from colliding with the developer rack or other developing modules.

46. The method of claim 45 wherein further actuating the lift assembly in the second direction to move the selected module away from the pre-developing position to the stored position includes:

further actuating the indexing system in the first direction so that the developer rack and toner cart move with the lift assembly to prevent the hook assembly and the selected module from colliding with the developer rack or the other developing modules.

47. The method of claim 43 and further including steps of:

repeating the method for moving the selected module between the stored position and the developing position and the method for moving the selected module between the developing position and the stored position for each developing module supported by the developer rack.

* * * * *

UNITED STATES PATENT AND TRADEMARK OFFICE

CERTIFICATE OF CORRECTION

PATENT NO. : 5,053,820

DATED : October 1, 1991

INVENTOR(S) : Duane A. Preszler et al.

It is certified that error appears in the above-identified patent and that said Letters Patent is hereby corrected as shown below:

Col. 17, line 11, delete "firs&." and insert --first--.

Signed and Sealed this

Twenty-first Day of June, 1994

*Attest:*

*Attesting Officer*

BRUCE LEHMAN

*Commissioner of Patents and Trademarks*